United States Patent [19]

Sugawara et al.

[11] Patent Number: 4,871,399

[45] Date of Patent: Oct. 3, 1989

[54] COPPER ALLOY FOR USE AS WIRING HARNESS TERMINAL MATERIAL AND PROCESS FOR PRODUCING THE SAME

[75] Inventors: Akira Sugawara; Naoyuki Kanahara, both of Hachioji, Japan

[73] Assignees: Dowa Mining Co., Ltd.; Yazaki Corporation, both of Tokyo, Japan

[21] Appl. No.: 186,176

[22] Filed: Apr. 26, 1988

[30] Foreign Application Priority Data

May 1, 1987 [JP] Japan ..... 62-106426

[51] Int. Cl.[4] ..... C21D 8/06

[52] U.S. Cl. ..... 148/11.5 C; 148/12.7 C; 148/413; 148/414

[58] Field of Search ..... 148/11.5 C, 12.7 C, 148/413, 414

[56] References Cited

U.S. PATENT DOCUMENTS 4,605,532 8/1986 Knorr et al. ..... 148/11.5 C
4,728,372 3/1988 Caron et al. ..... 148/12.7 C

FOREIGN PATENT DOCUMENTS 50453 3/1987 Japan ..... 148/11.5 C

*Primary Examiner*—L. Dewayne Rutledge

*Assistant Examiner*—George Wyszomierski

*Attorney, Agent, or Firm*—Frishauf, Holtz, Goodman & Woodward

[57] ABSTRACT

A copper alloy obtained by preparing a blank of an alloy that consists of 1.0–3.0% Ni, 0.5–1.5% Ti (the ratio of Ni/Ti in weight percent being in the range of 1–3), 0.1–2.0% Zn, 0.01–0.5% Mg, no more than 50 ppm of oxygen, and the balance being Cu and incidental impurities, all percents being on a weight basis; and reducing the thickness thereof to the final value by cold rolling, wherein at least one cycle of solution heat-treatment is applied at a temperature of not lower than 900° C., followed by quenching with water with no more than 50% reduction in plate thickness being attained to the final value subsequent to the final solution heat-treatment, and at least one cycle of aging treatment is applied at a temperature of 500°–600° C. for a period of 5–720 minutes at a stage during the period from the final solution heat-treatment to the cold rolling effected to attain the final plate thickness, has high strength, high elasticity and good electrical conductivity and exhibits good bending properties, high reliability in plating and high resistance to stress relaxation and, therefore, is suitable for use in terminals in wiring harnesses installed in electrical automotive parts.

8 Claims, No Drawings

COPPER ALLOY FOR USE AS WIRING HARNESS TERMINAL MATERIAL AND PROCESS FOR PRODUCING THE SAME

BACKGROUND OF THE INVENTION

The present invention relates to a copper alloy of high strength and electrical conductivity that is suitable for use in terminals in wiring harnesses installed in electrical automotive parts. The present invention also relates to a process for producing such a copper alloy.

The car industry has been playing an important role as one of the key industries in Japan. With the increase in the number of cars produced and, in particular, with the recent advances in car electronics technology, the use of rerolled copper materials has increased more than before. Wiring harnesses as an important class of automotive electrical parts are not an exception and their use has increased to such an extent that installing as much as 20 kg of wire harnesses 1 km long is one automobile is quite common practice. On the other hand, requirements of modern cars for lighter weight, higher reliability and lower cost have become stringest year by year and this has called for similar demands for wiring harnesses that are lighter in weight and ensure higher reliability and which yet can be manufactured at lower cost. A wiring harness is a unitary assembly of an electrical wire and associated terminals and in order to produce a wiring harness that is lightweight and which features high-density wiring, improvements in the characteristics and reliability of a terminal material are essential.

As mentioned above, terminals materials to be used in wiring harnesses are required to satisfy strict standards for characteristics; stated more specifically, they are required to have a strength of at least 55 kgf/mm$^2$, a threshold value of spring of at least 40 kgf/mm$^2$ and an electrical conductivity of at least 45% IACS while exhibiting good press formability, reliability in plating, and resistance to environmental factors. In particular, terminals to be used around the engine room are required to have good properties in terms of resistance to environmental factors and reliability in plating and therefore they must have high resistance to stress relaxation, corrosion and stress corrosion cracking in combination with good weatherability of plating deposited on such terminals. However, it has been very difficult for the prior art to attain those terminal materials that possess all of the characteristics described above and which yet can be manufactured at low cost.

SUMMARY OF THE INVENTION

The present invention has been accomplished in order to develop a copper alloy that possesses the characteristics described above that are required for wiring harness terminal materials to accommodate the recent advances in car electronics technology. An object, therefore, of the present invention is to provide a copper alloy for use as a wiring harness terminal material that has high strength, high elasticity and good electrical conductivity, and which also exhibits good bending properties, high reliability in plating and high resistance to stress relaxation.

This object of the present invention can be attained by a copper alloy that consists essentially of 1.0–3.0% Ni, 0.5–1.5% Ti (the ratio of Ni/Ti in weight percent being in the range of 1–3), 0.1–2.0% Zn, 0.01–0.5% Mg, no more than 50 ppm of oxygen, and the balance being Cu and incidental impurities, all percents being on a weight basis.

One of the characteristic features of the copper base alloy of the present invention is that by virtue of the addition of Ni and Ti in appropriate amounts, a Ni—Ti base intermetallic compound is precipitated in the Cu matrix uniformly and finely.

Therefore, according to the other aspect of the present invention, there is provided a process by which the above-described high-strength copper alloy can be produced in an advantageous way. This process comprises: preparing a blank of a copper alloy that consists of 1.0–3.0% Ni, 0.5–1.5% Ti (the ratio of Ni/Ti in weight percent being in the range of 1–3), 0.1–2.0% Zn, 0.01–0.5% Mg, no more than 50 ppm of oxygen, and the balance being Cu and incidental impurities, all percents being on a weight basis; and reducing the thickness of the blank to the final value by repeated cold rolling, wherein at least one cycle of solution heat-treatment is applied at a temperature of not lower than 900° C. during the repeated cold rolling, with no more than 50% reduction in plate thickness being attained by cold rolling to the final value subsequent to the final solution heat-treatment, and at least one cycle of aging treatment is applied at a temperature of 500°–600° C. for a period of 5–720 minutes at a stage during the period from the final solution heat-treatment to the cold rolling effected to attain the final plate thickness.

DETAILED DESCRIPTION OF THE INVENTION

The present invention is described hereinafter by first defining the criticality of the compositional ranges of the alloying elements incorporated in the alloy of the present invention.

The most important aspect of the copper base alloy of the present invention is that it successfully realizes precipitation hardening and dispersion hardening effects by forming a Ni—Ti base intermetallic compound. Therefore, Ni and Ti are indispensable elements in the alloy of the present invention.

Nickel is an element that forms a compound with Ti, thereby contributing to improvements in strength, elasticity and heat resistance. Nickel is also effective in refining the cast structure and hot structure while preventing grain growth during solution heat-treatments. In order for Ni to exhibit such effects, it must be incorporated in an amount of at least 1.0% (all percents appearing hereinafter are on a weight basis). However, if Ni is present in amount exceeding 3.0%, a significant decrease in electrical conductivity occurs and the temperature for solution heat-treatments is elevated to a level that is undesirable for manufacturing purposes. In addition, the use of more than 3.0% Ni is not economical. Therefore, the content of Ni is limited to be within the range of 1.0–3.0%.

If the content of Ti is less than 0.5%, it does not exhibit the desired effects for improving strength, elasticity and heat resistance even if it is present in combination with Ni. On the other hand, if the Ti content exceeds 1.5%, an excessive amount of a precipitate forms to reduce the ductility, bendability and platability of the alloy. Furthermore, not only the adhesion of plating under hot conditions but also the castability and hot rolling property of the alloy are impaired. Therefore, the content of Ti is limited to be within the range of 0.5–1.5%.

The objects of the present invention can be attained in an advantageous manner if Ni and Ti are precipitated as a Ni—Ti base intermetallic compound. The present inventors found that in order for the Ni—Ti base intermetallic compound to exhibit its strengthening effect to the fullest extent, the ratio of Ni/Ti in weight percent must be adjusted to be within the range of 1–3. If the Ni/Ti ratio is less than 1, Ti combined with Cu and a Ti—Cu base intermetallic compound will be precipitated upon aging. The precipitation of this Ti-Cu base intermetallic compound will not be detrimental to improvements in strength and elasticity. However, the improvement in electrical conductivity is small and grain growth will easily take place during solution heat-treatments, causing impaired bending property, in particular, the development of cracks and other surface flaws. In order to avoid such problems, the Ni/Ti ratio must be at least 1. On the other hand, if the Ni/Ti ratio exceeds 3, the high content of residual Ni in the matrix will cause not only reduced electrical conductivity but also poor adhesion of plating under hot conditions. For the reasons stated above, the Ni/Ti ratio must be within the range of 1–3 in order to fully exploit the advantages of the present invention.

Zinc is effective in improving the reliability of plating deposited on the alloy of the present invention. More specifically, Zn improves the adhesion of Sn plating or Sn—Pb plating under hot conditions. Terminals in wiring harnesses are usually plated with Sn or Sn—Pb. If the plated Sn or Sb—Pb is heated for a prolonged period by an application of an electric current or by the heat generated in the engine system, the added elements Ni and Ti will diffuse to the interface between the alloy (substrate) and the plating and form a reaction-diffusion layer with Sn. This reaction-diffusion layer is brittle and increases the chance of separation of the plating from the substrate, thereby reducing its reliability. If Zn is added, the diffusion of Ni and Ti in Cu is inhibited and the formation of a reaction-diffusion layer at the interface between the substrate and the plating can be effectively prevented. Therefore, Zn serves to improve the reliability of plating to be deposited on the alloy of the present invention. Zinc also has a deoxidizing action and hence can be used as a deoxidizer for the melt. It also has the ability to provide good melt flowability, thereby improving the castability of the alloy. In order to attain these effects, Zn must be incorporated in an amount of at least 0.1%. However, if the Zn content exceeds 2.0%, the electrical conductivity of the alloy is decreased and at the same time, it becomes increasingly sensitive to stress corrosion cracking, resulting in poor resistance to corrosion. Therefore, the content of Zn is limited to be within the range of 0.1–2.0%.

Not only Zn but also Mg contributes improved reliability of plating and deoxidizing action. Magnesium has the additional ability to improve the threshold value of spring of the alloy. In order to attain these effects, Mg must be incorporated in an amount of at least 0.01%. However, if the Mg content exceeds 0.5%, the electrical conductivity and bendability of the alloy are decreased. Therefore, the content of Mg is limited to be within the range of 0.01–0.5%.

If oxygen ($O_2$) is present in the alloy in an amount exceeding 50 ppm, the precipitating Ni—Ti base intermetallic compound will form a ternary compound with oxygen atom to produce a Ni—T—O base compound and not only the reliability of plating but also other characteristics of the alloy will be impaired. A high oxygen content also has the potential to cause hydrogen embrittlement both on the surface and in the bulk of the alloy if $H_2$ gas is used in the process of the production of the alloy. Therefore, the oxygen content of the alloy is limited to be no more than 50 ppm.

The copper alloy of the present invention so conditioned as to have the composition described above can be processed into a material that possesses the characteristics required for terminals useful in modern wiring harnesses by means of ensuring that a Ni—Ti base intermetallic compound is dispersed and precipitated in the matrix both uniformly and finely. The desired characteristics can be advantageously realized by employing a production process that is controlled in certain aspects, in particular, working and heat-treatment stages. Details of this process are shown hereinafter.

First, a slab or ingot is prepared by casting a melt of a composition that consists of 1.0–3.0% Ni, 0.5–1.5% Ti (the ratio of Ni/Ti in weight percent being in the range of 1–3), 0.1–2.0% Zn, 0.01–0.5% Mg, no more than 50 ppm of oxygen, and the balance being Cu and incidental impurities. The melting and casting operations are desirably performed in an inert gas or reducing gas atmosphere. In the next step, the slab or ingot is hot rolled and the rolled plate is descaled. Subsequently, the plate is cold rolled, with intermediate annealing being optionally performed, to reduce the plate thickness to no more than twice the final value, and a solution heat-treatment is thereafter performed. In other words, the plate subjected to a solution heat-treatment should not be reduced in thickness to the final value by more than 50% by subsequent cold rolling. If more than one cycle of solution heat-treatment is to be performed, the plate subjected to the final run of solution heat-treatment should not be reduced in thickness to the final value by more than 50% by subsequent cold rolling. If the reduction in plate thickness attained by cold rolling that follows the final solution heat-treatment exceeds 50% when the final thickness is attained, the internal strain created by working and aging treatments becomes excessively great and the bendability of the alloy is impaired. Therefore, it is recommended that no more than 50% reduction in plate thickness be attained by cold rolling to the final value subsequent to a solution heat-treatment.

The solution heat-treatment is preferably performed at a temperature of at least 900° C. Below 900° C., a satisfactory solution will not form and the coarse grained precipitate that has occurred during hot-rolling and annealing steps will disappear only insufficiently and the intended improvements in characteristics cannot be achieved. Below 900° C., it is also difficult to properly control the growth of crystal grains.

After the final run of solution heat-treatment, at least one aging treatment is performed during the process of reduction in plate thickness to the final value. This aging treatment is effective in improving the materials characteristics of the alloy, especially its electrical conductivity. The preferred conditions for the aging treatment to be conducted during the process of reduction in plate thickness to the final value following the final run of solution heat-treatment are a temperature in the range of 500°–600° C. and a period of 5–720 minutes. If the aging temperature is less than 500° C., too much time is required to produce a precipitate. If the temperature exceeds 600° C., the precipitate grows in crystal size and further improvements in alloy's characteristics cannot be achieved. Therefore, the aging temperature is preferably within the range of 500°-600° C. If the aging period is less than 5 minutes, the formation of a precipitate is insufficient. Aging for a period longer than 720 minutes is also undesired both from the viewpoint of crystal growth in the precipitate and from an economic viewpoint.

The aged material is cold rolled to the final plate thickness. If desired, it may be subjected to the final aging treatment so as to further improve its characteristics. This final aging treatment is performed at a temperature of 450°-600° C. for a period of 5-720 minutes. The lower limit of the heating temperature may be slightly lower than that selected for the aging treatment conducted during the process of cold rolling to the final plate thickness following the final solution heta-treatment. However, if the aging temperature is less than 450° C., the intended improvement in the threshold value of spring will not be attained. If the temperature exceeds 600° C., over aging occurs and the characteristics of the material are impaired. If the aging period is less than 5 minutes, the formation of a precipitate is insufficient. Aging for a period longer than 720 minutes is also undesired both from the viewpoint of crystal growth in the precipitate and from an economic viewpoint.

By employing the working and heat-treatment steps described above, there is produced a thin plate of copper base alloy having such a structure that a Ni—Ti base intermetallic compound is dispersed and precipitated in the Cu matrix both uniformly and finely. As will be described later in this specification by means of examples, this plate has high strength, high elasticity and good electrical conductivity and it is also improved in other aspects such as bendability, platability and resistance to stress relaxation. Therefore, it is suitable for use as a terminal material that enables the fabrication of wiring harnesses that satisfy two major requirements for modern products, i.e., lightweight and high wiring density.

Several typical examples are provided for the purpose of further illustrating the characteristics of the alloy of the present invention.

EXAMPLE 1

The melt of copper base alloy No. 1 having the chemical composition (wt %) shown in Table 1 was cast into an ingot (10 $mm^T \times 50\ mm^W \times 3{,}300\ mm^L$) with a horizontal continuous casting machine. The melting and casting operations were performed in an atmosphere completely shielded with argon gas. Sections measuring 10 $mm^T \times 50\ mm^W \times 50\ mm^L$ were cut from the ingot and hot rolled at 950° C. into plates 3 mm thick.

The hot rolled plates were scalped, rolled to a thickness of 1.2 mm and subjected to a solution heat-treatment at 950° C. for 60 minutes. The plates were thereafter quenched with water and pickled. The so prepared blanks 1.2 mm thick were worked and heat-treated under various conditions as described below in order to prepare a plurality of test pieces.

Preparation Method 1

The blank was cold rolled to a thickness of 0.55 mm, subjected to a final solution heat-treatment at 950° C. for 30 minutes, quenched with water, pickled and cold rolled to a thickness of 0.40 mm. The cold rolled plate was aged at 550° C. for 30 minutes, cold rolled to a final thickness of 0.32 mm, and aged at a final temperature of 480° C. for 30 minutes to prepare a test piece.

Preparation Method 2

The blank was cold rolled to a thickness of 0.60 mm, subjected to a final solution heat-treatment at 950° C. for 30 minutes, quenched with water, pickled and cold rolled to a thickness of 0.50 mm. The cold rolled plate was aged at 600° C. for 30 minutes, cold rolled to a final thickness of 0.40 mm, and aged at a final temperature of 450° C. for 30 minutes to prepare a test piece.

Preparation Method 3

The blank was cold rolled to a thickness of 0.80 mm, subjected to a final solution heat-treatment at 950° C. for 30 minutes, quenched with water, pickled and cold rolled to a thickness of 0.40 mm. The cold rolled plate was aged at 500° C. for 30 minutes to make a test piece. This test piece was a comparative sample prepared without performing an intermediate aging treatment.

Preparation Method 4

The blank was cold rolled to a thickness of 0.85 mm, subjected to a final solution heat-treatment at 950° C. for 30 minutes, water quenched, pickled and cold rolled to a thickness of 0.55 mm. The cold rolled plate was aged at 600° C. for 30 minutes, cold rolled to a final thickness of 0.40 mm, and aged at a final temperature of 500° C. for 30 minutes to make a test piece. This test piece was also a comparative sample in that after the final solution heat-treatment, the plate was cold rolled to the final thickness by more than 50% reduction.

Preparation Method 5

The blank was cold rolled to a thickness of 0.80 mm, subjected to a final solution heat-treatment at 950° C. for 30 minutes, water quenched, pickled and cold rolled to a thickness of 0.55 mm. The cold rolled plate was aged at 700° C. for 30 minutes, cold rolled to a final thickness of 0.40 mm, and aged at a final temperature of 500° C. for 30 minutes to make a test piece. This test piece was again a comparative sample because the intermediate aging temperature was higher than 600° C.

The test pieces thus prepared were subjected to measurements of hardness, tensile strength, threshold value of spring, electrical conductivity and bendability. The results are summarized in Table 2.

Measurements of hardness, tensile strength, threshold value of spring and electrical conductivity were conducted in accordance with JIS Z 2244, JIS Z 2241, JIS H 3130, and JIS H 0505, respectively. Bendability was determined by a 90° W. bend test (CES-MOOO2-6; R=0.4 mm; bent in both rolling and transverse directions). The results were evaluated by the following criteria: O, the surface of the ridge in the central portion was smooth; Δ, the surface of the central ridge wrinkled; X, cracks developed in that ridge.

As Table 2 shows, the alloy sample Nos. 1 and 2 that were prepared by the methods within the scope of the present invention attained good balance between hardness, tensile strength, threshold value of spring and electrical conductivity, plus good bendability. It is therefore clear that these alloys have characteristics that make them most suitable for use as terminal materials in a wiring harness.

Sample No. 3 (comparison) that was prepared without performing an aging treatment during the process of cold rolling to the final plate thickness following the final solution heat-treatment had an undesirably low electrical conductivity. Sample No. 4 (comparison) was prepared with an aging treatment performed during the process of cold rolling to the final plate thickness following the final solution heat-treatment but the reduction in plate thickness attained during this process was higher than 50%. Therefore, the bendability of this comparative sample was very poor. Sample No. 5 (comparison) was prepared with the intermediate aging treatment being conducted at a temperature higher than 600° C., so this comparative sample had undesirably low levels of tensile strength and threshold value of spring.

TABLE 1

| Alloy No. | Chemical Composition of Cu base alloy (wt %) | | | | | |
|---|---|---|---|---|---|---|
| | Ni | Ti | Ni/Ti | Zn | Mg | $O_2$ (ppm) |
| 1 | 2.01 | 0.84 | 2.4 | 0.57 | 0.10 | 7 |

TABLE 2

| | Preparation method | Hardness Hv | Tensile strength kgf/mm² | Threshold value of spring kgf/mm² | Electrical conductivity % IACS | 90° W bending (R = 0.4 mm) G.W. | B.W. |
|---|---|---|---|---|---|---|---|
| Method of the invention | 1 | 195 | 61.8 | 52.8 | 45.1 | Δ | Δ |
| | 2 | 181 | 56.6 | 45.1 | 50.6 | O | Δ |
| Comparative method | 3 | 188 | 58.1 | 53.7 | 32.6 | Δ | Δ |
| | 4 | 208 | 64.9 | 54.4 | 51.5 | X | X |
| | 5 | 174 | 55.8 | 40.7 | 49.2 | Δ | Δ |

GW.: Bending axis was perpendicular to the rolling direction
B.W.: Bending axis was parallel to the rolling direction

EXAMPLE 2

A test piece made by Preparation Method 1 from an alloy having the composition shown in Table 1 in Example 1, as well as commercially available Brass I (C 2600EH) and commercially available Phosphor Bronze II (C 5191H) were subjected to tests for harness, tensile strength, electrical conductivity, adhesion of solder plating under hot conditions, heat resistance, resistance to stress relaxation and resistance to corrosion stress cracking. The results are summarized in Table 3.

The measurements of hardness, tensile strength and electrical conductivity were conducted as in Example 1. The test for adhesion of solder plating under hot conditions was conducted by the following method: a test piece was plated with molten solder by dipping in Sn-40 wt % Pb bath at 230° C. for 5 sec using a weakly activated rosin flux; the plated test piece was heated at 150° C. for 200 hours in air atmosphere; thereafter, the test piece was bent by 90° W. and the bent portion was examined under a microscope at a magnification of 40. The test results were evaluated by the following criteria: O, the plating coat adhered strongly; X, the plating coat separated from the substrate. Heat resistance was evaluated by measuring the temperature at which the initial hardness of the test piece dropped to 80% upon holding at that temperature for 30 minutes. The test for stress relaxation was performed by bending the test piece into a U-shape in such a way that a stress of 40 kgf/mm² would be exerted upon the central portion. After holding the test piece in this state at 150° C. for 200 hours, percentage of stress relaxation was calculated by the following formula:

Stress relaxation $(\%)=[(L_1-L_2)/(L_1-L_0)]\times 100$ where $L_O$: the length of the jig (mm)

$L_1$: the length (mm) of the sample before test $L_2$: the horizontal distance (mm) between the two ends of the sample after heat treatment.

In the test for resistance to stress corrosion cracking, the test piece was bent in a U-shape as in the test for resistance to stress relaxation. The U-shaped test piece was held for 200 hours in a 14% aqueous ammonia filled desiccator (15°±5° C.). Thereafter, the central portion of the test piece was examined under a microscope at a magnification of 40 and evaluated by the following criteria: O, no cracks developed; X, cracking occurred.

TABLE 3

| | | Hardness Hv | Tensile strength kgf/mm² | Electrical conductivity % IACS | Adhesion of plating under hot conditions | Heat resisting temperature °C. | Stress relaxation % | Resistance to stress corrosion cracking |
|---|---|---|---|---|---|---|---|---|
| Alloy of the invention | Preparation Method 1 | 195 | 61.8 | 45.1 | O | more than 500 | 2.5 | O |
| Prior art alloys | C2600 EH | 174 | 55.3 | 26.9 | O | 320 | 47.1 | X |
| | C5191 H | 200 | 61.7 | 16.1 | O | 320 | 18.5 | O |

As Table 3 shows, the alloy of the present invention features a good balance between hardness, strength and electrical conductivity as compared with brass and phosphor bronze which are typically used as wire harness terminal materials in the prior art. One can also see from Table 3 that the alloy of the present invention exhibits high reliability of plating and high resistance to environmental factors. Stated more specifically, brass has low resistance to heat, stress relaxation and stress corrosion cracking, and phosphor bronze is low in resistance to heat and stress relaxation. On the other hand, the alloy of the present invention displays high resistance not only to heat and stress relaxation but also to stress corrosion cracking.

EXAMPLE 3

An alloy consisting of 1.99% Ni, 0.86% Ti (Ni/Ti=2.3), 0.49% Zn, 0.09% Mg, 76 ppm $O_2$ and the balance Cu (this alloy containing more $O_2$ than specified in the present invention and being referred to as alloy sample No. 2) was processed into a test piece by Preparation Method 1 as in Example 1. A test piece was also prepared form alloy sample No. 1 by Preparation Method 1.

The two test pieces were subjected to a test for the reliability of plating by the following procedures. The pieces were solder plated by dipping in a Sn-40 wt % Pb bath at 230° C. for 5 sec using a weakly activated rosin flux and heated at 150° C. for 200 hours in air atmosphere; thereafter, the test pieces were bent by 90° W. and an adhesive tape was attached to the bent portion of each test piece; after peeling the tape, the test area of each piece was examined under a microscope at a magnification of 40. The plated solder did not separate from the substrate at all when it was made of alloy sample No. 1 but partial separation occurred in the substrate of alloy No. 2.

As will be understood from the foregoing description, the present invention provides a copper base alloy for use as a wiring harness terminal material that has high strength, elasticity and electrical conductivity and which also exhibits good bendability, high reliability of plating and high resistance to environmental factors. A terminal material made of this alloy is highly adaptive to reduction in size and weight and increase in wiring density, which are two principal requirements to be satisfied by modern automotive electrical parts.

What is claimed is:

1. A process for producing a copper alloy for use as a wiring harness terminal material which comprises reducing the thickness of a blank of a copper alloy that consists essentially of 1.0–3.0% Ni. 0.5–1.5% Ti (the ratio of Ni/Ti in weight percent being in the range of 1–3), 0.1–2.0% Zn, 0.01–0.5% Mg, no more than 50 ppm of oxygen, and the balance being Cu and incidental impurities, all percents being on a weight basis to a final thickness dimension by at least three cold rolling operations;

after at least one of said cold rolling operations other than the final two of said at least three cold rolling operations and when said blank has been reduced in size to not more than twice the size of said final thickness dimension, solution heat treating said blank which has been reduced in size to not more than twice the size of said final thickness dimension at a temperature of not lower than 900° C. followed by quenching with water;

after at least one cold rolling operation which is subsequent to said solution heat-treatment, aging at a temperature of 500° C. to 600° C. for a period of 5 to 720 minutes wherein no further solution heat treating occurs after said aging; and final cold rolling followed by a subsequent aging heat-treatment at a temperature less than 500° C.

2. The process of claim 1 wherein said solution heat treatment is at a temperature of about 950° C. and said aging is at a temperature of 550° to 600° C. for about 30 minutes.

3. The process of claim 2 wherein said final aging heat treatment is at a temperature of 450° to 480° C. for about 30 minutes.

4. The process of claim 3 wherein said alloy consists of about 2.01% Ni, about 0.84% Ti (the ratio of Ni/Ti in weight percent being about 2.4), about 0.57% Zn, about 0.10% Mg, about 7 ppm oxygen, and the balance being Cu and incidental impurities, all percents being on weight basis.

5. The process of claim 3 wherein said alloy consists of 1.0–3.0% Ni, 0.5–1.5% Ti (the ratio of Ni/Ti in weight percent being in the range of 1–3), 0.1–2.0% Zn, 0.01–0.5% Mg, no more than 50 ppm of oxygen and the balance being Cu and incidental impurities, all percent being on a weight basis.

6. The process of claim 2 wherein said alloy consists of about 2.01% Ni, about 0.84% Ti ( the ratio of Ni/Ti in weight percent being about 2.4), about 0.57% Zn, about 0.10% Mg, about 7 ppm of oxygen, and the balance being CU and incidental impurities, all percents being on weight basis.

7. The process of claim 1 wherein said alloy consists of about 2.01% Ni, about 0.84% Ti (the ratio of Ni/Ti in weight percent being about 2.4), about 0.57% Zn, about 0.10% Mg, about 7 ppm of oxygen, and the balance being Cu and incidental impurities, all percents being on weight basis.

8. The process of claim 1 wherein said alloy consists of 1.0–3.0% Ni, 0.5–1.5% Ti (the ratio of Ni/Ti in weight percent being in the range of 1–3), 0.1–2.0% Zn, 0.01–0.5% Mg, no more than 50 ppm of oxygen and the balance being Cu and incidental impurities, all percents being on a weight basis.

* * * * *